US011408366B2

(12) United States Patent
Rottengruber et al.

(10) Patent No.: US 11,408,366 B2
(45) Date of Patent: Aug. 9, 2022

(54) CYLINDER ARRANGEMENT AND METHOD OF COOLING THE CYLINDER ARRANGEMENT

(71) Applicant: OTTO-VON-GUERICKE-UNIVERSITAET MAGDEBURG, Magdeburg (DE)

(72) Inventors: Herrmann Rottengruber, Unterschleissheim (DE); Johannes Oder, Magdeburg (DE); Thilo Wagner, Magdeburg (DE)

(73) Assignee: OTTO-VON-GUERICKE-UNIVERSITAET MAGDEBURG, Magdeburg (DE)

( * ) Notice: Subject to any disclaimer, the term of this patent is extended or adjusted under 35 U.S.C. 154(b) by 0 days.

(21) Appl. No.: 17/296,219

(22) PCT Filed: Nov. 27, 2019

(86) PCT No.: PCT/DE2019/000304
§ 371 (c)(1),
(2) Date: May 21, 2021

(87) PCT Pub. No.: WO2020/108677
PCT Pub. Date: Jun. 4, 2020

(65) Prior Publication Data

US 2022/0018307 A1 Jan. 20, 2022

(30) Foreign Application Priority Data

Dec. 1, 2018 (DE) ..... 102018009442.2

(51) Int. Cl.
*F02F 1/14* (2006.01)
*F01P 3/02* (2006.01)
*F02F 1/02* (2006.01)

(52) U.S. Cl.
CPC . *F02F 1/02* (2013.01); *F02F 1/14* (2013.01)

(58) Field of Classification Search
CPC ..... F01P 3/02; F01P 2003/027; F01P 11/16; F02F 1/14; F02F 1/16; F02F 1/004
See application file for complete search history.

(56) References Cited

U.S. PATENT DOCUMENTS 4,466,399 A 8/1984 Hinz et al.
4,926,801 A * 5/1990 Eisenberg ..... F02F 1/163 123/193.2

(Continued)

FOREIGN PATENT DOCUMENTS

AT 228013 B 6/1963
DE 969880 C 7/1958

(Continued)

OTHER PUBLICATIONS

International Search Report dated Apr. 28, 2020 of counterpart PCT/DE2019/000304 (4 pages).

*Primary Examiner* — Long T Tran
(74) *Attorney, Agent, or Firm* — Cohen & Hildebrand, PLLC

(57) ABSTRACT

Cylinder arrangement (1) and method for cooling the cylinder arrangement (1) addresses a solution with which the heat transfer from a combustion chamber (6) of an internal combustion engine located in a cylinder liner (2) of the cylinder arrangement (1) into a region (7) surrounding the cylinder liner (2), such as a cylinder block or crankcase, is controlled in a temperature-dependent manner. Arrangement solves said problem by providing a jacket (9), the expansion of which changes depending on temperature, arranged between the cylinder liner (2) and the region (7) surrounding the cylinder liner (2). The method uses the cylinder liner (2) with a jacket (9), expands depending on temperature and surrounds the cylinder liner (2); jacket (9) forms a gap (10) between jacket (9) and region (7) in a first temperature (Continued)

range; jacket (9) forms no gap (10) between jacket (9) and region (7) in a second temperature range.

19 Claims, 2 Drawing Sheets

(56) References Cited

U.S. PATENT DOCUMENTS

| | | | | |
|---|---|---|---|---|
| 5,239,949 | A * | 8/1993 | Elsbett | F01P 3/08 123/41.35 |
| 8,037,851 | B2 * | 10/2011 | Kobayashi | F02F 1/14 123/41.14 |
| 8,919,302 | B2 * | 12/2014 | Hamakawa | F02F 1/166 123/41.74 |
| 10,424,710 | B2 * | 9/2019 | Salvador | H01L 35/30 |
| 2008/0060593 | A1 | 3/2008 | Nakada et al. | |
| 2009/0031978 | A1 * | 2/2009 | Kobayashi | F02N 19/10 165/10 |

FOREIGN PATENT DOCUMENTS

| | | | |
|---|---|---|---|
| DE | 3134768 | A1 | 3/1983 |
| DE | 3643828 | A1 | 6/1988 |
| EP | 3376010 | A1 | 9/2018 |
| WO | 2005/024214 | A2 | 3/2005 |
| WO | 2017110665 | A1 | 6/2017 |

* cited by examiner

CYLINDER ARRANGEMENT AND METHOD OF COOLING THE CYLINDER ARRANGEMENT

This application is a national stage application, filed under 35 USC § 371, of International Patent Application No. PCT/DE2019/000304, filed on Nov. 27, 2019, claiming priority to DE 10 2018 009442.2 filed on Dec. 1, 2018, each of which is herein incorporated by reference in its entirety.

BACKGROUND OF THE INVENTION

(1) Field of the Invention

The invention relates to a cylinder arrangement, comprising a cylinder liner for receiving a piston and a cylinder block surrounding the cylinder liner.

The invention also relates to a method for cooling a cylinder arrangement, wherein a cylinder liner for receiving a piston and a region surrounding the cylinder liner are provided and wherein the heat generated in a combustion chamber of the cylinder liner is transferred to the region surrounding the cylinder liner.

It is provided here that a region surrounding the cylinder liner is a cylinder block or a cylinder crankcase, into which the generated heat is transferred or dissipated.

In internal combustion engines, which typically have pistons moving inside cylinders, the combustion process of the fuel generates high temperatures in the combustion chambers of the cylinders, which necessitate heat transfer from the combustion chambers or cylinders, for example to a region surrounding the cylinder such as a cylinder block or a cylinder crankcase. Typically, a cooling system is provided to prevent overheating in an internal combustion engine. Such cooling systems may operate, for example, with a cooling fluid which is passed through special channels arranged in the cylinder block and thus ensures heat is extracted from the cylinder block or the cylinder crankcase. This allows, for example, heat transfer from the combustion chamber of the internal combustion engine to a coolant in a coolant circuit of a vehicle, which has a corresponding cooler or heat exchanger for cooling the coolant.

The employed active or passive cooling systems reduce the thermal load, in particular on the cylinders or cylinder liners as well as on the pistons of the internal combustion engine. In addition, the heat transfer prevents a thermal change in the employed lubricants, for example coking of the lubricant.

Disadvantageously, with such a cooling system, the heat transfer from the combustion chamber of the internal combustion engine also occurs in an operating phase immediately after the internal combustion engine is started. In this first temperature range or state where the cylinders or cylinder liners are at a low temperature, it would be advantageous to prevent heat dissipation until the internal combustion engine has reached a so-called operating temperature in the region of the cylinders or cylinder liners.

Reaching such an operating temperature quickly, which may, for example, be in a range from 100° C. to about 150° C., would improve the efficiency of the internal combustion engine, lead to fuel savings and reduce emissions, because an operating temperature must be reached for an optimal operation of a catalytic converter. However, this operating temperature is usually only reached after the internal combustion engine has warmed up.

(2) Description of Related Art

Various arrangements of pistons in internal combustion engines guided inside cylinder liners are known in the art, which address the problem of heat transfer or adequate cooling of an internal combustion engine of this type, in some cases also with the possibility of dispensing with cooling.

WO 2005/024214 A2 discloses a cylinder block for a water-cooled internal combustion engine with at least one cylinder surrounded by a cooling jacket with a connection surface for a cylinder head, which has at least one transfer opening for coolant from the cooling jacket into the cylinder head. The object of the document to be solved is to influence both the flow of coolant between the cylinder block and cylinder head and the flow within the cylinder block in the simplest possible way.

According to the invention, this is achieved by inserting a flow limiter into the transfer opening, wherein the flow limiter is arranged at least partially within the cooling jacket. It is also disclosed that the flow limiter is formed by a pipe, wherein the outside diameter of the flow limiter corresponds essentially to the diameter of the transfer opening and the flow limiter is composed of a metal or plastic.

DE 31 34 768 A1 discloses a piston-cylinder unit for an internal combustion piston engine, in particular for gasoline and diesel engines. The problem to be solved is to propose a piston-cylinder unit which obviates the need for piston rings for sealing between the piston and the cylinder liner, thus producing overall a unit able to withstand high thermal loads.

To solve this problem, the cylinder liner is surrounded by a bandage composed of a fiber composite material with a thermal expansion that is less in the radial direction than the thermal expansion of the cylinder liner, wherein the expansion restriction caused by the bandage is different over the length of the cylinder liner.

It is also provided that the piston has a cap with a piston crown facing the combustion chamber and a substantially cylindrical piston skirt adjacent to the cylinder running surface and a force introduction core, which has the bearing for the piston pin and the spherical pressure surface. It is also disclosed that above the spherical surface a force-introducing connection between the piston crown and the force introduction core is provided which is rotationally symmetrical with respect to the piston longitudinal axis, that the cap is connected to the force introduction core at the lower edge of the piston skirt, without any other contact between the cap and the force introduction core except in the region of the force introducing connection, and that both the cylinder liner and the cap are made of a ceramic material.

DE 36 43 828 A1 discloses an engine cylinder and engine piston for an uncooled internal combustion piston engine, in particular for a four-stroke diesel engine with an exhaust gas turbocharger. The intent is to create a reliably functioning piston seal towards the combustion chamber with low leakage losses of combustion gases while, at the same time, precisely guiding the central piston with respect to the engine cylinder.

For this purpose, the piston shaft is provided with a labyrinth seal that runs inside the cylinder liner without making contact and with the least possible play, wherein a piston guide tube is firmly inserted inside the cylinder liner for the sole purpose of guiding the engine piston relative to the engine cylinder on the underside of the piston head, wherein the piston guide tube slides in a free-standing guide liner arranged in a region with relatively low temperatures and serves with its lower end for the articulation of a connecting rod. In this way, the produced friction and the wear and tear on the mechanical components can be reduced and active cooling can be dispensed with.

So-called vehicle catalytic converters, also referred to as catalytic converters for short, are also known in the prior art. Vehicle catalytic converters are used for exhaust aftertreatment in vehicles with internal combustion engines. The task of the catalytic converter is to reduce the pollutant emissions in the exhaust gas such that the emission of air pollutants stays below or at most approaches predetermined limit values. These limit values are regulated, for example, in various Euro standards. For proper exhaust gas aftertreatment by the catalytic converter, a specified working temperature must be reached at which the chemical reactions necessary for cleaning can take place. This temperature is known as the "light-off temperature". Until this temperature is reached, the catalytic converter does not work properly or is in an operating mode in which the exhaust gases are only cleaned to a limited expansion. The aim is to achieve the "light-off temperature" as quickly as possible after starting an internal combustion engine from a cold operating state.

It is also known from the prior art to permanently insulate a combustion chamber in an internal combustion engine from the cylinder block and thus to prevent heat transfer. This method, which is disclosed in Woschni, G.: Influence of combustion chamber insulation on fuel consumption and heat flows in diesel engines. MTZ 49, pp. 281-285 (1988), has a negative effect on the efficiency of the internal combustion engine, in particular due to the heating of the charge and the disproportionately increasing heat transfer coefficient at the hot cylinder wall, at least in a second temperature range of the internal combustion engine in which an operating temperature has been reached.

AT 228 013 B discloses a water-cooled internal combustion engine and a method for producing a cooling water ducting jacket. The object is here to produce the closed cooling water ducting jacket provided to prevent cavitation from a material that can be formed directly in the cylinder block. For this purpose, the closed cooling water ducting jacket surrounding the entire cylinder circumference of the cylinder liner with play is formed from a plastic body formed directly in the cooling water space of the cylinder block from a plastic that is hot water-resistant or corrosion protection oil-resistant, such as polyester alone, or is formed with a filler made of asbestos, glass wool, sawdust and the like.

DE 969 880 B discloses an insert liner with a sleeve surrounding the insert liner for piston engines. The written description relates in particular to an insert liner intended for piston engines, especially internal combustion engines, having an upper collar which is clamped, on the one hand, between the cylinder head and, on the other hand, between a sleeve surrounding the liner and resiliently supported on the cylinder block, wherein according to the invention the lower contact surface of the sleeve is supported against the guide collar serving to guide the lower end of the liner.

The disadvantage of the solutions known from the prior art is that the heat transfer from the combustion chamber of an internal combustion engine to a cylinder block and thus to the cooling water is determined only by way of the existing temperature difference.

It is also disadvantageous that in some cases special and therefore complex mechanical solutions are required, for example when active cooling is to be dispensed with.

BRIEF SUMMARY OF THE INVENTION

There is thus a need for a solution for influencing the heat transfer in an internal combustion engine.

The object of the invention is to provide a cylinder arrangement and a method for cooling the cylinder arrangement, with which heat transfer from a combustion chamber of an internal combustion engine located in a cylinder liner of the cylinder arrangement into a region surrounding the cylinder liner, such as a cylinder block or a cylinder crankcase, is controlled as a function of the temperature.

The object is achieved by an arrangement with the features according to claim 1 of the independent claims. Further developments are recited in the dependent claims 2 to 5.

The object is also achieved by a method having the features according to claim 6 of the independent claims. Further developments are recited in the dependent claims 7 to 11.

It is contemplated to arrange a cylinder liner or an inner sleeve in the cylinder arrangement of an internal combustion engine which is in a conventional manner in contact with the piston. In this case, the combustion chamber can also be sealed in a conventional manner by using piston rings.

The cylinder liner may have a wear-resistant surface, which is also referred to as a running surface, facing inwardly towards the piston.

The cylinder liner may have a similar coefficient of expansion as the piston or the piston rings so as not to adversely affect the clearance between the piston and the cylinder liner when the internal combustion engine warms up during operation.

According to the invention, the heat transfer between a cylinder liner in a cylinder arrangement of an internal combustion engine and a region surrounding the cylinder liner or the cylinder arrangement, such as a cylinder block or a cylinder crankcase, may be influenced depending on the temperature of the cylinder liner or the temperature in the cylinder arrangement, such as, for example in a combustion chamber.

In a first temperature range in which the temperature of the internal combustion engine is low, for example after the internal combustion engine has been started, the heat transfer from the region of the cylinder liner to the region surrounding the cylinder liner, such as a cylinder block or a cylinder crankcase, may de interrupted or greatly reduced. Such a first temperature range may be, for example, between −20° C. and 100° C.

In a second temperature range or state in which the temperature of the internal combustion engine is higher or high, for example after a warm-up phase of the internal combustion engine, the heat transfer between the cylinder liner of the cylinder arrangement and the region surrounding the cylinder liner, such as a cylinder block or a cylinder crankcase, may be improved to ensure the necessary heat transfer or cooling required to operate the internal combustion engine. The second temperature range is also dependent on the type and structure of the internal combustion engine and may, for example, be between 100° C. and about 150° C., in particular between 100° C. and 140° C.

A jacket, which has an expansion that changes as a function of temperature, may be provided between the cylinder liner and a region surrounding the cylinder liner for influencing or controlling the heat transfer. This jacket is arranged between the cylinder liner and the region surrounding the cylinder liner, for example a cylinder block.

The jacket, which has an expansion that changes as a function of the temperature, causes in a first temperature range the formation of a gap between the jacket itself and the region surrounding the cylinder liner or the cylinder block of the internal combustion engine. The formed gap which can be filled with air, for example, reduces the heat transfer from the cylinder liner to the cylinder block or to the cylinder crankcase. This reduced heat transfer causes the cylinder liner and the piston of the internal combustion engine to warm up faster, so that the operating temperature is reached more quickly.

The jacket, which has an expansion that changes as a function of temperature, does not cause the formation of a gap between the jacket and the region surrounding the cylinder liner or the cylinder block of the internal combustion engine in a second temperature range that is different from the first temperature range.

The jacket thus ensures heat transfer in the second temperature range in which the internal combustion engine has already reached its operating temperature. Since there is no longer a gap between the jacket and the region surrounding the cylinder liner or the cylinder block of the internal combustion engine, the heat transfer to the region of the cylinder block or the region of the cylinder crankcase through which a cooling fluid can flow can take place undisturbed.

The temperature-dependent formation of the gap may be achieved in that the jacket has a thermal expansion coefficient that is different from that of the cylinder liner. Thus, the jacket changes its radial expansion or its circumference with increasing temperature and closes the formed gap.

Alternatively, the jacket may be made from materials such as a bi-metal or a shape-memory alloy. In this embodiment, too, the jacket changes its radial expansion or its circumference with increasing temperature and closes the formed gap.

Alternatively, the jacket may also be provided with an arrangement that actively changes its radial expansion or its circumference as a function of temperature. In this case, the change in the jacket may be controlled or brought about by using an actuator. Such an actuator may be operated electrically, for example. Alternatively, such an actuator may also be operated piezoelectrically or magnetically or electromagnetically.

The previously explained features and advantages of this invention can be better understood and assessed after careful study of the following detailed description of the preferred, non-limiting example embodiments of the invention in conjunction with the accompanying drawings, which show in:

DETAILED DESCRIPTION OF THE INVENTION

Figure 1:
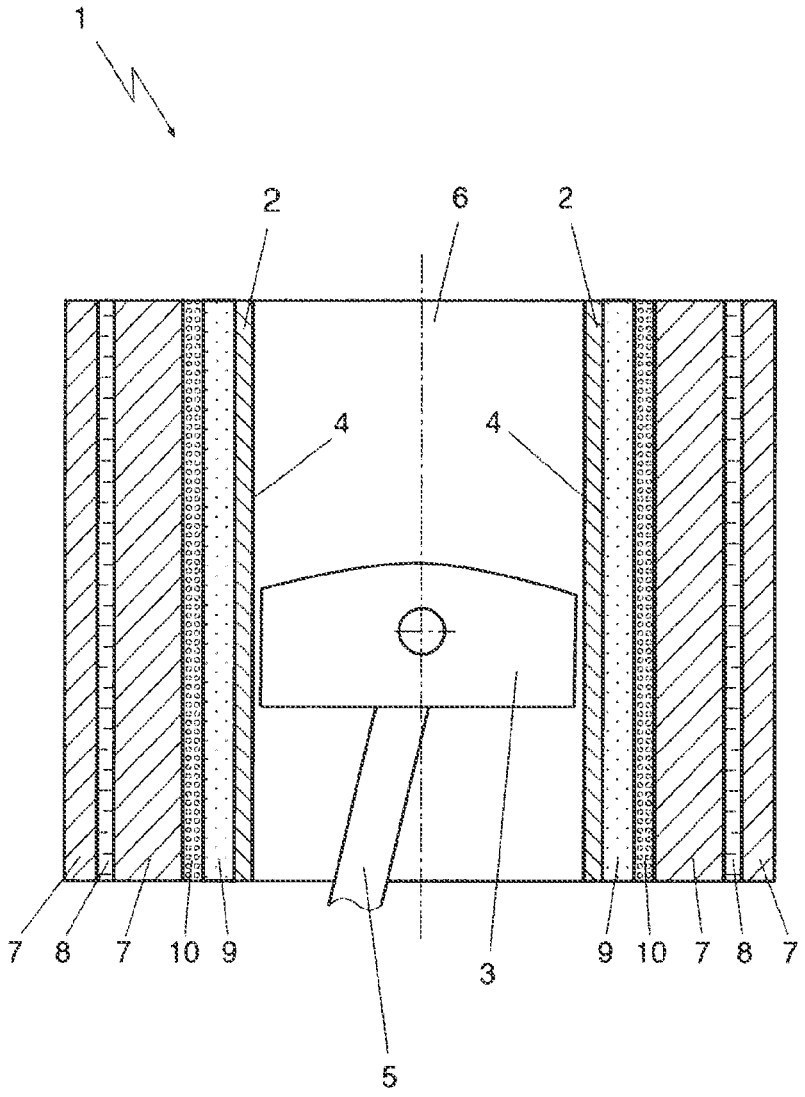
FIG. 1: a cylinder arrangement according to the invention in a first temperature range.

FIG. 1 shows the cylinder arrangement 1 according to the invention, which is arranged in an internal combustion engine, in a first temperature range. This first temperature range occurs, for example, in a phase in which the cylinder arrangement 1 is cold and the internal combustion engine has not yet reached a so-called operating temperature. Such state occurs, for example, when the internal combustion engine is started.

The cylinder arrangement 1 includes a cylinder liner 2 in which a piston 3 moves along the running surface 4. The piston 3 is connected in the usual way to a crankshaft (not shown) via the connecting rod 5. The combustion chamber 6, which is formed by a cylinder head (not shown) disposed above the cylinder liner 2, is arranged above the piston 3.

The running surface 4 has a wear-resistant surface. The piston 3, which can advantageously be provided with piston rings (not shown in FIG. 1), moves over this running surface 4.

In order not to adversely influence the play between piston 3 and cylinder liner 2 during a warm-up phase of the internal combustion engine, the assemblies may have a similar coefficient of thermal expansion.

The cylinder liner 2 is surrounded by a jacket 9 which, for example, surrounds the entire cylinder liner 2. The cylinder liner 2 with its jacket 9 is surrounded by a region 7 which is subsequently intended to be a cylinder block 7 or a cylinder crankcase, for example.

Such a region or cylinder block 7 may have channels 8 through which a cooling fluid flows. Such cooling fluid improves heat transfer during operation of the internal combustion engine, because the cooling fluid extracts heat from the cylinder block 7.

In the first temperature range or state of the internal combustion engine, during a starting phase, the temperature of the internal combustion engine and of the cylinder arrangement 1 is low. In this phase, which is also referred to as the cold state of the internal combustion engine, the internal combustion engine has, for example, a temperature similar to that of its surroundings. Depending on the weather, this temperature can be, for example, in the range from −20° C. to 100° C., in particular in a range from −15° C. to 30° C.

In this first temperature range, a gas-filled gap 10 is formed between the jacket 9, the cylinder liner 2 and the cylinder block 7. Such a gas can be air, for example. This gas-filled gap 10 has an insulating effect, meaning that the heat transfer between the cylinder liner 2 and the cylinder block 7 is severely limited or reduced. In this case, the heat transfer between the jacket 9, the cylinder liner 2 and the cylinder block 7 is limited to convection and heat radiation in the gap 10 and is thus greatly reduced.

The reduction in the heat transfer causes the cylinder liner 2 with the piston 3 to warm up faster, so that an operating temperature of the cylinder arrangement 1 can be reached more quickly than with an arrangement without an air gap 10.

Upon reaching the operating temperature, the running properties of the internal combustion engine and its efficiency improve. In addition, the working temperature required for a catalytic converter to function efficiently, the so-called "light-off temperature", is reached earlier. This obviates, for example, the need for additional devices required in catalytic converters to quickly reach their working temperature, or their operating time can be greatly reduced. Thus, cost and/or energy savings can be expected. Such an additionally necessary device in a catalytic converter may be, for example, an electrical heater.

Advantageously, quickly reaching the operating temperature of the internal combustion engine or the working temperature of the catalytic converter saves fuel.

Figure 2:
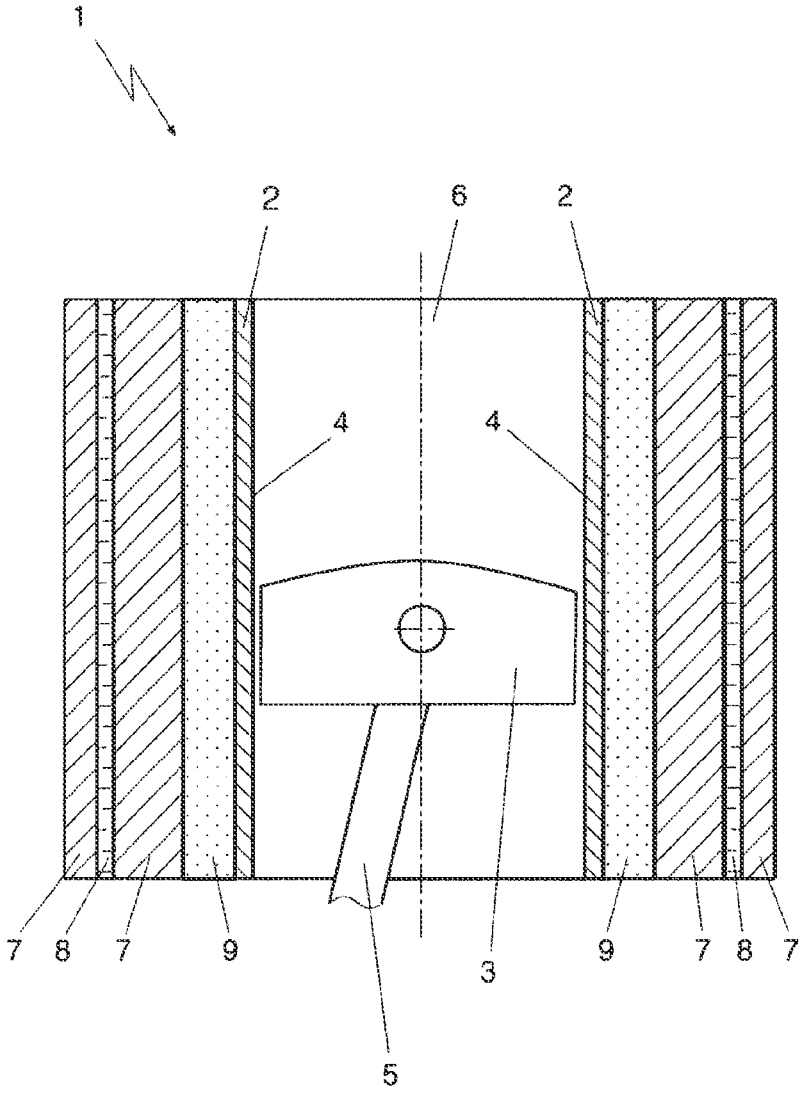
FIG. 2: a cylinder arrangement according to the invention in a second temperature range.

FIG. 2 shows a cylinder arrangement 1 according to the invention in a second temperature range or state.

This second state is, for example, a phase in which the internal combustion engine with the cylinder arrangement 1 is warm and has reached the operating temperature. Such a state occurs, for example, when the internal combustion engine has been operating after a warm-up time of a few minutes, for example. It is known that this time is also dependent on the load or loading of the internal combustion engine.

FIG. 2 shows the cylinder arrangement 1 of the cylinder liner 2, in which the piston 3 moves along the running surface 4. The piston 3 is connected in a conventional manner to a crankshaft (not shown) via the connecting rod 5. The combustion chamber 6, which is formed by a cylinder head (not shown) arranged above the cylinder liner 2, is arranged above the piston 3.

The cylinder liner 2 is surrounded by the jacket 9, with the jacket 9 being enclosed by the cylinder block 7. The illustration of FIG. 2 also shows schematically channels 8 in the cylinder block 7, through which a coolant can flow during the operation of the internal combustion engine.

In contrast to FIG. 1, the jacket 9 has changed in such a way that a gap 10 is no longer formed between the jacket 9 and the cylinder block 7. In this case, the heat generated during the combustion in the combustion chamber 6 can also be dissipated via the cylinder liner 2 and the jacket 9 in the cylinder block 7. In this second temperature range or state, heat can be transferred between the jacket 9 of the cylinder liner 2 and the cylinder block 7 through heat conduction and heat dissipation of the internal combustion engine is thus much greater than in the first temperature range.

The coolant flowing through the channels 8 is provided to dissipate the heat from the cylinder block 7. The coolant circulates in a conventional coolant circuit of an internal combustion engine and thus contributes to the heat transfer from the cylinder block 7.

In a first variant, the jacket 9 may be composed of a material that has a thermal expansion coefficient different from that of the cylinder liner 2. Thus, with a suitable choice of the thermal expansion coefficient, the jacket 9 may, due to its thermal expansion and thus depending on the temperature in a first cold state of the first temperature range, form a gap 10 towards the cylinder block 7. In a second temperature range having a higher temperature, such as the operating temperature of the internal combustion engine, the jacket 9 closes the gap 10 due to its thermal expansion.

In a second variant, the jacket 9 may have a thermally active construction which changes the expansion of the jacket 9 as a function of temperature. For this purpose, for example, bi-metals or a shape memory alloy are used in the jacket 9 or in the region of the jacket 9. Such a jacket 9 forms in a first temperature range or a state of low temperature a corresponding gap 10. In a second temperature range or state of higher temperature, the bi-metals or the shape memory alloy of the jacket 9 expand, closing the gap 10, for example at a defined temperature.

In a further variant, the jacket 9 may have an active adjustment designed to control the expansion of the jacket 9, for example in its radial direction or its circumference. For this purpose, actuators with a corresponding adjustment device for the jacket 9 can be used. Such actuators can be operated, for example, electrically, piezoelectrically or magnetically, and thus change the gap 10 as a function of temperature.

The principle and structure described for the jacket 9 can also be applied to the regions of the cylinder head of the internal combustion engine or the pistons 3.

According to the invention, it is thus possible to control the warm-up of an internal combustion engine by specifically influencing the possible heat transfer from the combustion chamber 6 via the cylinder liner 2 to the cylinder block 7. Quickly reaching the working temperature of a catalytic converter of the internal combustion engine is ensured by reducing the heat transfer in a first temperature range or a state of low temperature.

Particular advantages of the present invention are listed below:

- With the cylinder arrangement according to the invention, an improved warm-up of an internal combustion engine is achieved, since in a first temperature range of a warm-up phase the heat losses, i.e. the dissipation of heat generated in the combustion chamber of the cylinder arrangement, for example to the cylinder block or a cylinder crankcase, are reduced.
- Faster warm-up of the components near the combustion chamber is possible.
- Shift of the energy distribution towards the exhaust gas and associated higher exhaust gas temperatures to reach the light-off temperature more quickly.
- Fuel savings.
- Further advantages for the operation at low ambient temperatures and in the low-load range.
- Better mixture formation occurs faster due to a shorter warm-up phase.
- Emissions decrease as the light-off temperature is reached more quickly.

LIST OF REFERENCE SYMBOLS

1 Cylinder arrangement
2 Cylinder liner
3 Piston
4 Running surface
5 Connecting rod
6 Combustion chamber
7 Region around the cylinder liner (cylinder block/cylinder crankcase)
8 Channels
9 Jacket
10 Gap

The invention claimed is:

1. A cylinder arrangement (1), comprising a cylinder liner (2) for receiving a piston (3) and a region (7) surrounding the cylinder liner (2), wherein a jacket (9) having an expansion that changes as a function of temperature is arranged between the cylinder liner (2) and the region (7) surrounding the cylinder liner (2), and that the jacket (9) forms a gap (10) in a first temperature range and does not form a gap (10) in a second temperature range, wherein the gap is disposed in the first temperature range between the jacket (9) and the surrounding region (7).

2. The arrangement according to claim 1, wherein the jacket (9) has a different thermal expansion coefficient than the cylinder liner (2).

3. The arrangement according to claim 1, wherein the jacket (9) has a thermally active construction.

4. The arrangement according to claim 3, wherein the jacket (9) is composed of a bi-metal or a shape memory alloy.

5. The arrangement according to claim 1, wherein an arrangement for actively changing radial expansion or circumference of the jacket (9) as a function of temperature is arranged on the jacket (9).

6. The arrangement according to claim 5, wherein the arrangement for actively changing the radial expansion or the circumference of the jacket (9) comprises an electrically, piezoelectrically or magnetically operated actuator.

7. The arrangement according to claim 1, wherein a surface area of physical contact between the jacket (9) and the cylinder liner (2) remains unchanged in both the first temperature range and the second temperature range.

8. The arrangement according to claim 1, wherein the first temperature range is between −20° C. and 100° C. and the second temperature range is between 100° C. and 140° C.

9. The arrangement according to claim 1, wherein the gap (10) is filled with a gas.

10. The arrangement according to claim 9, wherein the gas is air.

11. A method for cooling a cylinder arrangement (1), comprising the steps of:

providing a cylinder liner (2) for receiving a piston (3) and a region (7) surrounding the cylinder liner (2); and transferring heat generated in a combustion chamber (6) of the cylinder liner (2) to the region (7) surrounding the cylinder liner (2), wherein the cylinder liner (2) is provided with a jacket (9) which surrounds the cylinder liner (2) and has an expansion that changes as a function of temperature, the jacket (9) forms in a first temperature range a gap (10) between the jacket (9) and the region (7) and the jacket (9) does not form a gap (10) between the jacket and the region (7) in a second temperature range.

12. The method according to claim 11, wherein the jacket (9) has a thermal expansion coefficient that is different from the thermal expansion coefficient of the cylinder liner (2) and causes a change in radial expansion or circumference of the jacket (9).

13. The method according to claim 12, wherein the jacket (9) is provided with a thermally active construction which causes a change in the radial expansion or the circumference of the jacket (9), wherein the thermally active construction is provided with a bi-metal or a shape memory alloy.

14. The method according to claim 12, wherein the jacket (9) is provided with an arrangement for actively changing of the radial expansion or the circumference of the jacket (9) as a function of temperature.

15. The method according to claim 14, wherein the temperature-dependent, active change in the radial expansion or the circumference of the jacket (9) takes place by way of an electrically, piezoelectrically or magnetically operated actuator.

16. The method according to claim 11, wherein the first temperature range is between −20° C. and 100° C. and the second temperature range is between 100° C. and 140° C.

17. The method according to claim 11, wherein a surface area of physical contact between the jacket (9) and the cylinder liner (2) remains unchanged in both the first temperature range and the second temperature range.

18. The method according to claim 11, wherein the gap (10) is filled with a gas.

19. The method according to claim 18, wherein the gas is air.

* * * * *